US007011298B2

(12) United States Patent
Gerhardy et al.

(10) Patent No.: US 7,011,298 B2
(45) Date of Patent: Mar. 14, 2006

(54) INTAKE DEVICE

(75) Inventors: Reinhard Gerhardy, Korb (DE); Klaus Geyer, Sulzbach (DE)

(73) Assignee: Andreas Stihl AG & Co. KG, (DE)

( * ) Notice: Subject to any disclaimer, the term of this patent is extended or adjusted under 35 U.S.C. 154(b) by 38 days.

(21) Appl. No.: 10/659,841

(22) Filed: Sep. 11, 2003

(65) Prior Publication Data

US 2004/0051186 A1 Mar. 18, 2004

(30) Foreign Application Priority Data

Sep. 18, 2002 (DE) ..... 102 43 166
Jun. 10, 2003 (DE) ..... 103 26 488

(51) Int. Cl.
*F02M 7/24* (2006.01)

(52) U.S. Cl. ..... 261/46; 123/73 PP; 261/47; 261/63; 261/DIG. 1

(58) Field of Classification Search ..... 261/23.3, 261/35, 46, 47, 63, DIG. 1; 123/73 PP
See application file for complete search history.

(56) References Cited

U.S. PATENT DOCUMENTS 3,205,879 A * 9/1965 Von Seggern et al. ..... 123/581
3,439,658 A * 4/1969 Simonet ..... 123/277
3,916,851 A * 11/1975 Otani ..... 123/73 A
4,086,885 A * 5/1978 Noguchi et al. ..... 123/274
4,094,931 A * 6/1978 Karino ..... 261/123.3
4,138,974 A * 2/1979 Takemoto et al. ..... 123/320
4,232,640 A * 11/1980 Matsumoto et al. ..... 123/308
4,294,205 A * 10/1981 Iiyama et al. ..... 123/274
6,101,991 A * 8/2000 Glover ..... 123/73 PP
2003/0106508 A1 * 6/2003 Rosskamp ..... 123/73 PP
2003/0192492 A1 * 10/2003 Yuasa et al. ..... 123/73 PP
2004/0168656 A1 * 9/2004 Carlsson et al. ..... 123/73 PP

FOREIGN PATENT DOCUMENTS

| | | | | |
|---|---|---|---|---|
| EP | 1 221 545 | | 7/2002 | |
| GB | 2 384 822 | | 8/2003 | |
| JP | 53-25718 | * | 3/1978 | ..... 261/23.3 |
| JP | 57-32044 | * | 2/1982 | ..... 261/23.3 |
| JP | 57-83651 | * | 5/1982 | ..... 261/23.3 |
| WO | WO 01/51785 | | 7/2001 | |

* cited by examiner

*Primary Examiner*—Richard L. Chiesa
(74) *Attorney, Agent, or Firm*—R W Becker & Associates; R W Becker

(57) ABSTRACT

An intake device having an intake channel that includes an intake channel section is provided. A butterfly valve is pivotably mounted in the intake channel section. A dividing wall is disposed downstream of the butterfly valve and divides the intake channel section into an air duct and a mixture duct. The air duct has a flow cross-section that is greater than the flow cross-section of the mixture duct. A fuel jet opens into the mixture duct.

20 Claims, 4 Drawing Sheets

INTAKE DEVICE

BACKGROUND OF THE INVENTION

The present invention relates to an aspirating or intake device, in particular for the internal combustion engine in an engine-driven tool such as a chain saw or parting-off grinder, etc.

An intake device in which the intake port is divided into one air duct and two mixture ducts is known from EP 1 221 545 A2. To achieve this a dividing wall is provided which extends essentially downstream of the throttle valve and divides the intake port centrically. The flow cross-sections in the air duct and the mixture duct are thus roughly the same size. The largely fuel-free air supplied to the engine through the air duct serves to separate exhaust gases escaping from the combustion chamber of the engine from the fuel/air mixture flowing after them. If too little air is supplied to the internal combustion engine, it is impossible to separate the mixture from the exhaust gases cleanly and uncombusted fuel/air mixture is therefore able to escape from the combustion chamber outlet. This reduces the exhaust gas quality. At the same time the fuel consumption of the engine increases.

The object of the present invention is to create an intake device of the aforementioned general type which provides a sufficient quantity of largely fuel-free air for an internal combustion engine.

SUMMARY OF THE INVENTION

This object is realized with an intake device of the present invention that has an intake channel that includes the intake channel section, a butterfly valve pivotably mounted in the intake channel section, a dividing wall disposed downstream of the butterfly valve and dividing the intake channel section into an air duct and a mixture duct, wherein the air duct has a flow cross-section that is greater than the flow cross-section of the mixture duct, and wherein a fuel jet opens into the mixture duct.

According to the invention, the divided intake port is not divided symmetrically into an air duct and a mixture duct. Rather, the division is effected such that the flow cross-section in the air duct is greater than the flow cross-section in the mixture duct. If the air duct and/or the mixture duct are then sub-divided into more than one duct, their total flow cross-sections are represented by the sum of the individual flow cross-sections. The fact that the cross-section of the air duct is greater than that of the mixture duct allows the supply of a large quantity of largely fuel-free air. As a result, it is possible to separate mixture and exhaust gas in the combustion chamber of the engine well and no uncombusted fuel is therefore able to escape from the combustion chamber. This improves the exhaust quality and reduces the amount of fuel required by the internal combustion engine.

Good separation of fuel and exhaust gas is achieved if the flow cross-section in the air duct represents 55% to 90% of the total flow cross-section of the intake port. In order to achieve different flow cross-sections in the intake duct and the mixture duct, the longitudinal axis of the throttle shaft is located a distance from the intake port longitudinal axis which measures between 0.5 mm and 5 mm, in particular approximately 2 mm. In this arrangement, the throttle valve is fixed in particular asymmetrically to the throttle shaft so that the throttle valve is able to largely close the intake port even if the throttle shaft is positioned eccentrically in the intake port. The asymmetrical positioning of the throttle valve permits a non-symmetrical division of the intake port into air duct and mixture duct. With a distance of approximately 2 mm, the pivoting movement of the throttle valve is thus hardly restricted. The dividing wall in the intake port is positioned in such a manner that the longitudinal center line of the dividing wall is located a distance from the intake port longitudinal axis of 5% to 30% of the diameter of the intake port. In order to achieve a sufficient reduction of the flow cross-sections of the mixture duct, the dividing wall has a thickness which represents 10% to 40% of the diameter of the intake port. In this arrangement the dividing wall extends in particular essentially to the side of the throttle shaft facing the mixture duct.

In order not to reduce the flow cross-section in the air duct, the throttle valve is positioned on the throttle shaft on the side facing the air duct. In particular, the intake port upstream of the throttle valve is divided by a dividing wall, the distance between the dividing wall and the longitudinal axis of the throttle shaft corresponding approximately to the radius of the throttle shaft. The extension of the dividing wall into the area upstream of the throttle valve prevents any fuel from spitting back into the air duct. By virtue of the fact that the dividing wall extends right up to the throttle shaft, the space between the dividing wall and the throttle shaft is largely sealed so that no fuel is able to pass from the mixture duct into the air duct between the throttle shaft and the dividing wall. The radius of the throttle shaft advantageously represents some 15% to 40% of the diameter of the intake port.

Simple assembly and manufacture of the intake device are achieved when the dividing wall upstream of the throttle valve is formed by a choke valve mounted in the intake port in such a manner that it is able to pivot. This eliminates the need to position a separate dividing wall upstream of the throttle valve in the intake port. In order to achieve a good seal, the choke valve has in particular a rectangular form. To avoid gaps between the choke valve and the throttle valve, in the open position the choke valve and the throttle valve are inclined towards the intake port longitudinal axis and in one area lie adjacent to one another.

In order to reduce the flow cross-section in the mixture duct a cross-section-reducing acctivity or ramp can usefully be positioned in the mixture duct which, when the throttle valve is in the open position, is located a certain distance from the throttle valve. The distance advantageously represents 10% to 40%, in particular 20% to 30%, of the diameter of the intake port.

An advantageous version is created if the throttle valve in the mixture duct opens in the direction of flow. The throttle valve thus forms a dividing wall between the mixture duct and the air duct downstream of the throttle shaft which is effective even before the throttle valve is fully open. The fuel jet is advantageously fed by a fuel metering system which adjusts the quantity of fuel fed to the mixture duct dependent on the position of the throttle valve. This means that the quantity of fuel supplied is largely independent of the pressure conditions in the intake port. This eliminates the need for the positioning of a venturi tube in the intake port. In particular, the fuel jet opens downstream of the throttle valve into the mixture duct. This largely prevents fuel from spitting back.

An advantageous, simple version of the intake device can be achieved if the section of the intake port downstream of the throttle valve is designed in the form of a flange. In particular, the fuel jet opens in the flange. This means that the intake device is simple to manufacture. The large spatial distance between the fuel jet and the opening in the dividing wall positioned in the area of the throttle valve reliably prevents any overflowing of fuel into the air duct.

In the case of emulsion-type carburetors, in particular, the fuel jet is an idle jet and a main jet is provided upstream of the idle jet. At idle, fuel and combustion air can thus be drawn into the idle jet via the main jet. In this arrangement, the intake of fuel into the air duct is avoided by the arrangement of the idle jet. However, it can also be advantageous for a fuel jet in a carburetor to open into the mixture duct. Simple manufacture of the intake device can also be achieved by designing the dividing wall positioned downstream of the throttle valve as one piece with the flange. This also simplifies the fitting of the throttle valve to the throttle shaft since access to the throttle valve prior to the fitting of the flange is not restricted by the dividing wall. The flange is in particular a connecting flange. However, the flange may also be the intake flange of an internal combustion engine.

BRIEF DESCRIPTION OF THE DRAWINGS

Embodiments of the invention are explained below with reference to the drawing.

DESCRIPTION OF PREFERRED EMBODIMENTS

Figure 1:
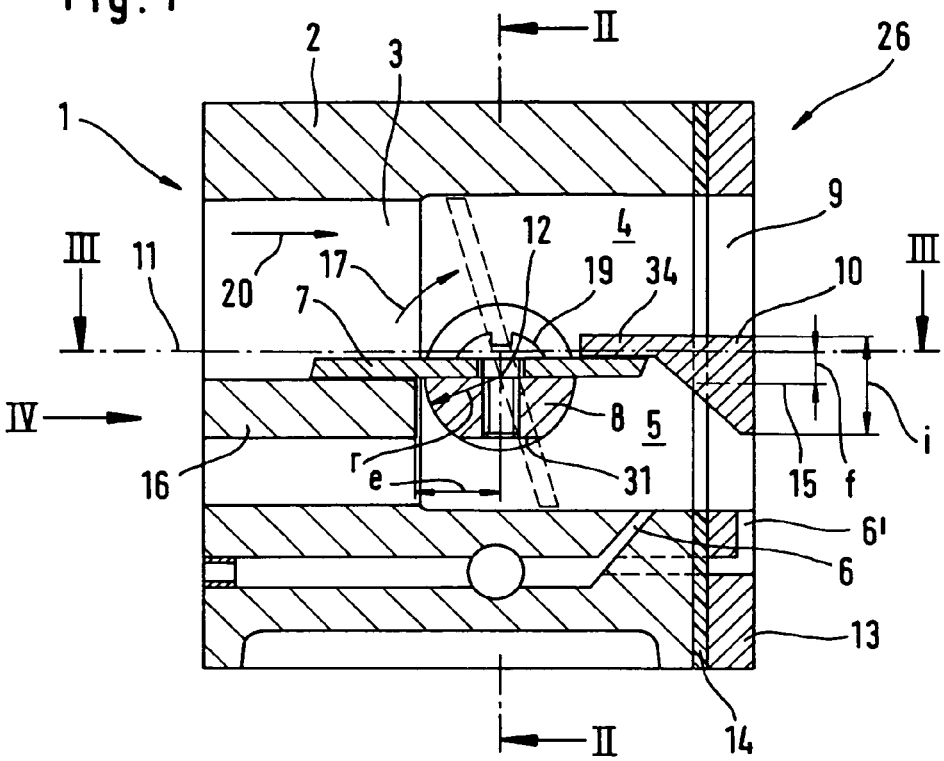
FIG. 1 shows a schematic view of a longitudinal section through an intake device.

FIG. 1 shows an aspirating or intake device 26 which has an intake port or channel 9. An intake port section 3 of the intake port 9 is formed in a carburetor 1. The carburetor 1 has a carburetor housing 2 and serves to supply fuel/air mixture and largely fuel-free combustion air to an internal combustion engine. The internal combustion engine is in particular a two-stroke engine, the combustion air serving as scavenging air to separate exhaust gas and the fuel/air mixture which follows it in the combustion chamber. The air passes through the carburetor 1 in the direction of flow 20. An air filter is advantageously positioned upstream of the carburetor 1. A throttle or butterfly valve 7 with a throttle shaft 8 is mounted in the intake port section 3 in such a manner that it is able to pivot. The intake port 9 is divided into an air duct 4 and a mixture duct 5 by a dividing wall 16 upstream of the throttle valve and by a dividing wall 10 downstream of the throttle valve 7. A fuel jet 6 opens into the mixture duct 5 downstream of the throttle valve 7. The outlet of the fuel jet 6 may be located in the carburetor housing 2, but it may also be useful to permit the fuel jet to open into a flange 13 positioned downstream of the carburetor 1 as illustrated in FIG. 1 with the broken line fuel jet 6'. In this arrangement, the flange 13 is in particular a connecting flange, for example between the carburetor 1 and an internal combustion engine. However, the flange 13 may also be the intake flange of the internal combustion engine. The arrangement of the outlet opening of the fuel jet 6' in the flange 13 results in a simple process for the manufacture of both carburetor 1 and flange 13. The arrangement of the outlet opening in the flange 13 represents an independently inventive idea. In particular, the arrangement of the outlet opening in the flange 13 is also advantageous in intake devices in which the air duct 4 and the mixture duct 5 have the same flow cross-section. Positioned between the carburetor 1 and the flange 13 is a seal 14. The flange 13 may serve as a connecting piece between the carburetor and the internal combustion engine.

When the throttle valve 7 is in the open position illustrated in FIG. 1, the throttle valve 7 lies parallel to the intake port longitudinal axis 11 in the intake port section 3. In the open position of the throttle valve 7 indicated by the broken line, the throttle valve 7 largely closes the intake port 9. The throttle valve 7 can be pivoted from the open position in the direction of opening 17 to the closed position. In the air duct 4 the throttle valve 7 thereby opens against the direction of flow 20, while in the mixture, duct 5 it opens in the direction of flow 20. When the throttle valve 7 is in the open position, the dividing wall 16 positioned upstream of the throttle valve 7 lies on the side of the throttle valve 7 facing the mixture duct. The dividing wall 16 thereby divides the intake port 3 unsymmetrically into an air duct with a large cross-section and a mixture duct with a smaller cross-section. The dividing wall 10 positioned downstream of the throttle valve 7 is also positioned unsymmetrically in the intake port 9. The longitudinal center line (15) of the dividing wall 10 is located a distance (f) from the intake port longitudinal axis 11. This distance represents in particular 5% to 30% of the diameter (D) of the intake port 9 illustrated in FIG. 4. The thickness (i) of the dividing wall 10 represents 10% to 40% of the diameter (D) of the intake port 3. Formed on the dividing wall 10 is a shoulder 34 against which the throttle valve 7 lies in the open position.

Figure 3:
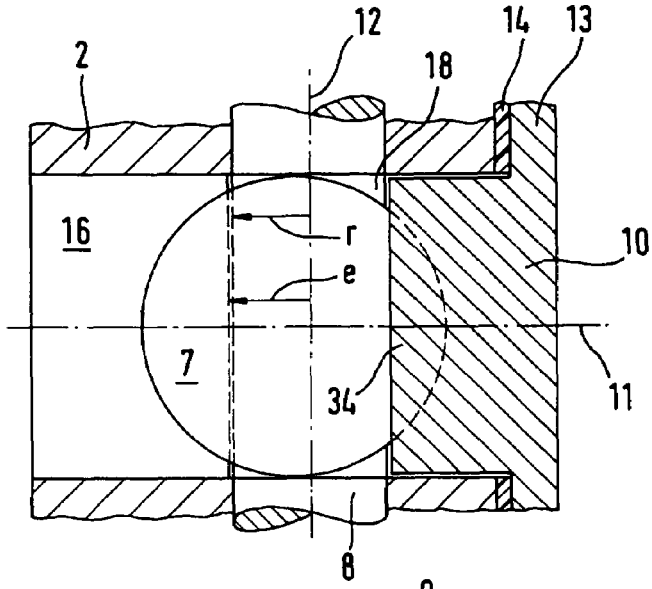
FIG. 3 shows a section along the line marked III—III in FIG. 1.

As also illustrated in FIG. 3, the longitudinal axis (12) of the throttle shaft 8 is located a distance (e) from the dividing wall 16 which corresponds roughly to the radius (r) of the throttle shaft 8. In this arrangement, the throttle valve 7 is fixed asymmetrically to the throttle shaft 8 so that the longitudinal axis (12) of the throttle shaft 8 is located at a distance from the geometric mid-point of the throttle valve 7. As the throttle valve 7 is opened in the direction of opening 17, the mixture duct 5 and the air duct 4 are therefore closed between the dividing wall 16 and the throttle shaft 8. Although a gap is formed between the throttle valve 7 and the downstream dividing wall 10, it is impossible for mixture from the mixture duct to overflow into the air duct through it since the gap is covered in the direction of flow 20 by the throttle valve 7. The mixture duct 5 and the air duct 4 are therefore effectively separated from one another.

Figure 2:
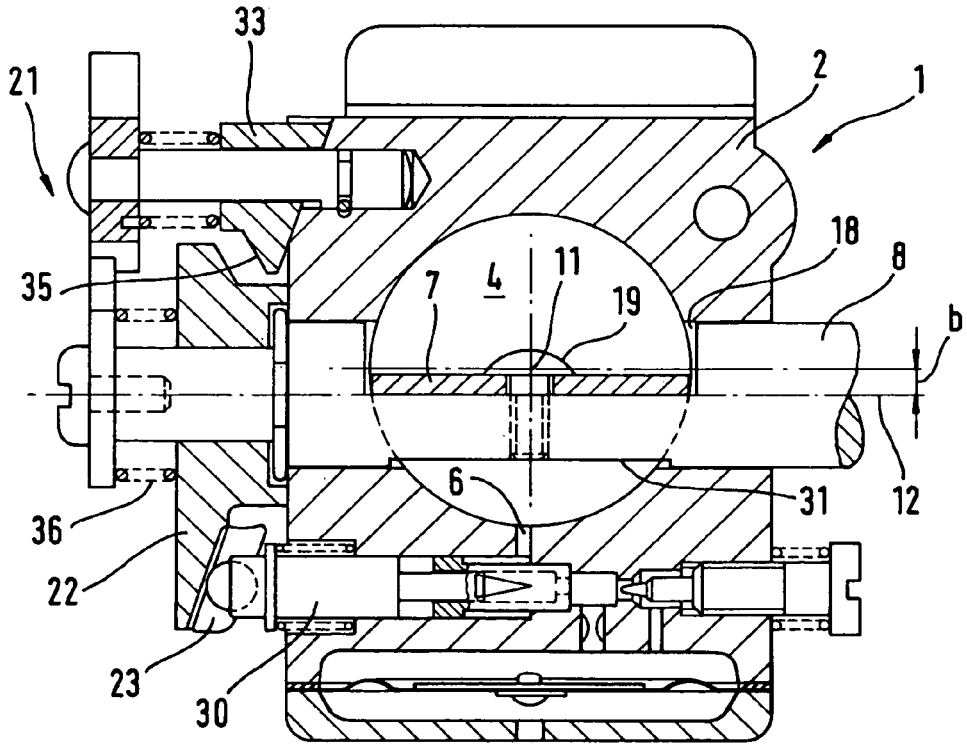
FIG. 2 shows a section along the line marked II—II in FIG. 1.

As illustrated in FIG. 2, the longitudinal axis (12) of the throttle valve 7 is a distance (b) from the intake port longitudinal axis 11. The distance (b) measures 0.5 mm to 5 mm, but in particular some 2 mm. In the area of the intake port 3 on the side facing the air duct 4, the throttle shaft 8 has a recess (18) in which is positioned the throttle valve 7. The throttle valve 7 is screwed onto the throttle shaft 8 by a screw (19). By positioning the throttle valve 7 on the side of the throttle shaft 8 facing the air duct 4, any reduction of the flow cross-section of the air duct 4 by the throttle shaft 8 is avoided. In order to avoid turbulence in the mixture duct, there is on the side of the throttle shaft 8 facing the mixture duct 5 a flat area (31). As illustrated in FIG. 1, the flat area (31) forms an extension of the dividing wall 16 in order to avoid turbulence in the air flow.

The carburetor 1 has a fuel metering system (21) which feeds fuel to the fuel jet 6 dependent on the position of the throttle valve 7. To this end is provided a lever (22) which is connected to the throttle shaft 8 in such a manner that it is unable to rotate. Formed on the lever (22) is an acclivity or ramp (23) which opens and closes a metering jet (30) dependent on the position of the throttle shaft 8. This regulates the amount of fuel fed to the fuel jet 6. For starting, a small volume of combustion air and a comparably large amount of fuel must be supplied to the internal combustion engine. The metering jet (30) must therefore be wide open for starting, while the throttle valve 7 is only slightly open. In order to supply a large amount of fuel on starting, a lever (33) is provided which is drawn out of the carburetor housing 2 on starting and thereby acts on the lever (22) via an acclivity or ramp (35). The lever (22) is lifted out of the carburetor housing 2 against the force of the spring (36). This opens the metering jet.

FIG. 3 shows the division of air duct 4 and mixture duct 5 in top view. The dividing wall 10 is designed as one piece with the flange 13 and downstream of the throttle shaft 8 fits close to the throttle shaft 8. In this arrangement, the throttle shaft 8 and the dividing wall 10 lie adjacent to one another at the shoulder 34. Upstream of the throttle valve 7 the dividing wall 16 is positioned a distance (e) from the longitudinal axis (12) of the throttle shaft 8. The throttle valve 7 lies on the dividing wall 16. The dividing wall 16 is manufactured as one piece with the carburetor housing 2. In order to manufacture the carburetor 1, the throttle valve 7 is first screwed to the throttle shaft 8 in the carburetor housing 2 at the screw (19) illustrated in FIGS. 1 and 2. The flange 13 and the seal 14 are then connected to the carburetor housing 2. This allows simple manufacture and assembly.

Figure 4:
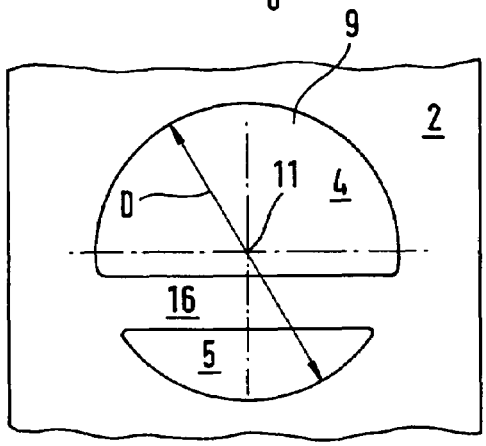
FIG. 4 shows a view in the direction of the arrow marked IV in FIG. 1.

As illustrated in FIG. 4, the air duct 4 has a larger flow cross-section than the mixture duct 5. The flow cross-section of the air duct 4 advantageously represents 55% to 90% of the total flow cross-section of the intake port 3. In this arrangement, the air duct 4 and the mixture duct 5 are divided by the dividing wall 16 upstream of the throttle valve 7.

Figure 5:
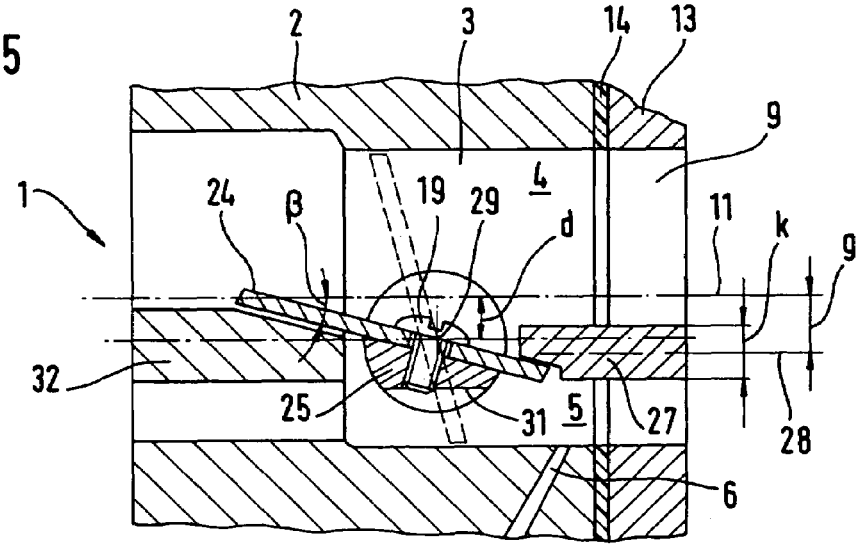
FIG. 5 shows a schematic view of a longitudinal section through an intake device.

FIG. 5 shows a version of a carburetor 1. The same reference numerals are used to indicate the same components as in FIGS. 1 to 4. The throttle valve (24) is mounted with the throttle shaft (25) in the intake port section 3 in such a manner that it is able to rotate. In this arrangement, the throttle valve (24) is positioned on the side of the throttle shaft (25) facing the air duct 4 and fixed by means of a screw (19). The throttle shaft (25) has a flat area (31) on the side facing the mixture duct 5. The flat area (31) forms an extension of a dividing wall (32) positioned upstream of the throttle valve (24). Positioned downstream of the throttle valve 7 is a dividing wall (27). The dividing walls (32 and 27) divide the intake port 9 eccentrically. The longitudinal center line (28) of the dividing wall (27) is positioned a distance (g) from the intake port longitudinal axis 11 which represents 5% to 30% of the diameter (D) of the intake port 3. The thickness (k) of the dividing wall (27) represents 10% to 40% of the diameter (D) of the intake port 3. In this arrangement, the dividing wall (32) and the dividing wall (27) are positioned on the side of the intake port longitudinal axis 11 facing the mixture duct 5. The throttle valve (24) is also positioned eccentrically in the intake port 9. The longitudinal axis (29) of the throttle shaft (25) is positioned a distance (d) from the intake port longitudinal axis 11 which measures 0.5 mm to 5 mm. In the closed position, the throttle valve (24) is inclined at an angle (β) in relation to the intake port longitudinal axis 11. Said angle may measure some 15°, for example. By inclining the throttle valve (24) in the direction of closing, it is possible to increase the distance (d). The flow cross-section in the air duct 4 can thus be increased in relation to the flow cross-section in the mixture duct 5. The flow cross-section in the air duct 4 advantageously represents 55% to 90% of the total flow cross-section in the intake port 9.

Figure 6:
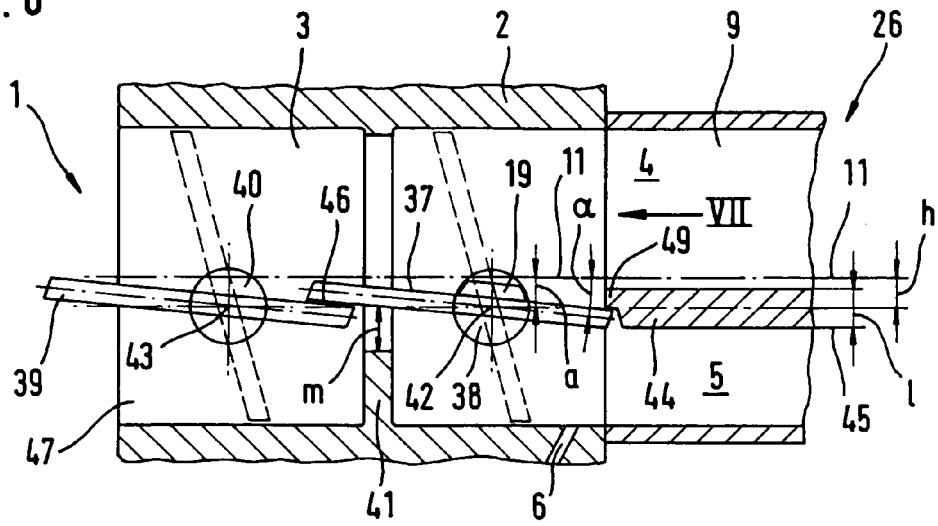
FIG. 6 shows a schematic view of a longitudinal section through an intake device.
Figure 8:
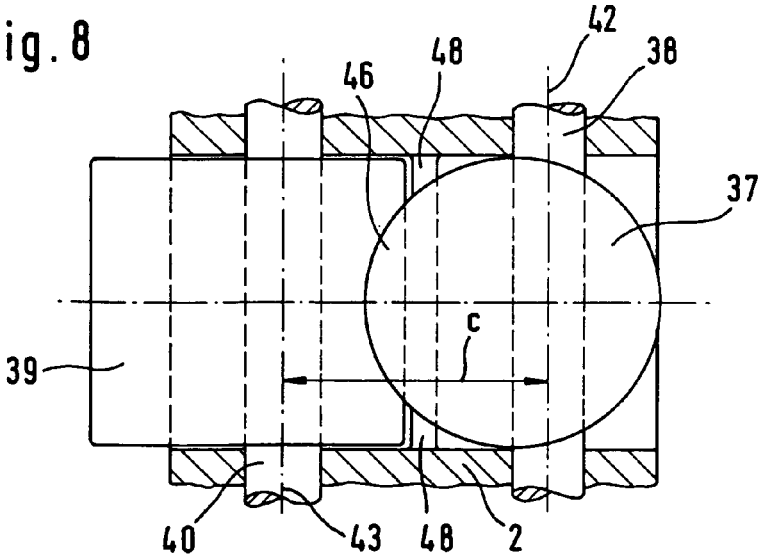
FIG. 8 shows a schematic longitudinal section through the carburetor illustrated in FIG. 6, and FIGS. 9, 10 and 11 show schematic longitudinal sections through intake devices.

FIG. 6 shows a version of an intake device 26. Mounted in a carburetor 1 in such a manner that it is able to pivot is a throttle valve (37) with a throttle shaft (38). Mounted upstream of the throttle valve (37) in such a manner that it is able to pivot is a choke valve (39) with a choke shaft (40). As illustrated in FIG. 8, the choke valve (39) has a rectangular, in particular roughly square form. The choke valve (39) is positioned in a longitudinal section (47) of the intake port 9 which has a rectangular cross-section. Both the longitudinal axis (43) of the choke shaft (40) and the longitudinal axis (42) of the throttle shaft (38) are positioned a distance (a) from the intake port longitudinal axis 11 which measures between 0.5 mm and 5 mm. The longitudinal axis (42) of the throttle shaft (38) is thus located a certain distance from the geometric midpoint of the throttle valve (37) and the longitudinal axis (43) of the choke shaft (40) is located a certain distance from the geometric mid-point of the choke valve (39). The choke valve (39) and the throttle valve (37) are thus mounted asymmetrically on the choke shaft (40) and the throttle shaft (38) respectively.

With the throttle and choke valves in the open position illustrated in FIG. 6, the throttle valve (37) and the choke valve (39) are inclined at an angle (α) in relation to the intake port longitudinal axis 11 which may measure approximately 10°. In this arrangement, as also shown in FIG. 8, the throttle valve (37) and the choke valve (39) lie adjacent to one another in an area (46). The distance (c) between the longitudinal axes (42 and 43) of the throttle shaft (38) and choke shaft (40) illustrated in FIG. 8 is dimensioned such that the area (46) in which the throttle valve (37) and the choke valve (39) are adjacent to one another extends over a large part of the width of the intake port 9. The mixture duct 5 and the air duct 4 are connected together upstream of the throttle valve (37) in lateral areas (48) only. The choke valve (39) thus forms a part of the dividing wall.

Figure 7:
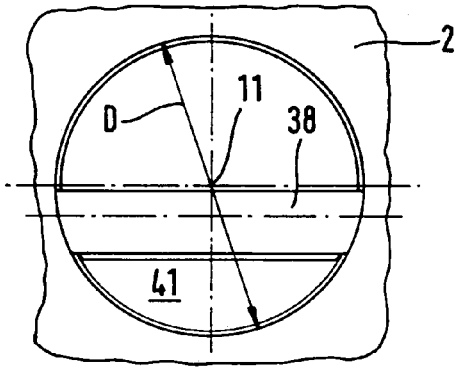
FIG. 7 shows a view in the direction of the arrow marked VII in FIG. 6.

The dividing wall (44) positioned downstream of the throttle valve (37) is positioned eccentrically in the intake port 9, the longitudinal center line (45) of the dividing wall (44) being positioned a distance (h) from the intake port longitudinal axis 11 which represents some 5% to 30% of the diameter (D) of the intake port 9 illustrated in FIG. 7. The dividing wall (44) has a thickness (I) which represents 10% to 40% of the diameter (D) of the intake port 9. Formed in the area of the throttle valve at the dividing wall (44) is a shoulder (49) against which the throttle valve (37) lies in the open position. Positioned between the throttle valve (37) and the choke valve (39) in the intake port 9 is an acclivity or ramp (41) in the mixture duct 5 which reduces the cross-section of the mixture duct 5 even further. When the throttle valve (37) is in the open position, the ramp (41) is located a distance (m) from the throttle valve (37) which in particular represents 10% to 40% and advantageously 20% to 30% of the diameter (D) of the intake port 9. The fuel jet illustrated in FIG. 6 is usefully supplied by a fuel metering system in accordance with the fuel metering system (21) illustrated in FIG. 2.

When operating the intake device with a two-stroke engine with scavenging, a division into 30% of the total flow area for the mixture duct 5 and 70% of the total flow area for the air duct 4 has proved to be an advantageous flow cross-section ratio.

Figure 9:
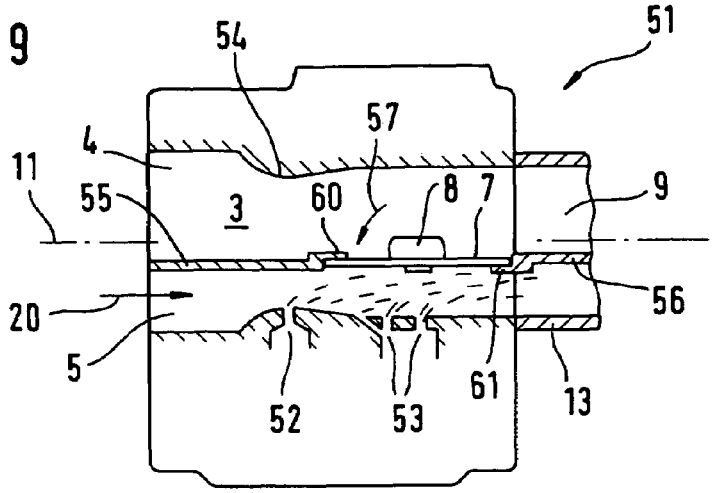

FIG. 9 shows an embodiment of a carburetor 1. Located in the carburetor (51) is an intake port section 3. Mounted in the intake port 9 in such a manner that it is able to rotate is a throttle valve 7 with a throttle shaft 8. Fitted in the carburetor (51) upstream of the throttle valve 7 in relation to the direction of flow 20 from an air filter to an internal combustion engine is a venturi tube (54). Upstream of the throttle valve 7 the intake port 9 is divided into an air duct 4 and a mixture duct 5 by a dividing wall (55). Downstream of the throttle valve 7 it is divided by a dividing wall (56). Positioned on the dividing wall (55) on the side facing the throttle valve 7 is a shoulder (60) against which the throttle valve 7 lies in the fully open position, i.e. when the throttle valve 7 extends roughly parallel to the intake port longitudinal axis 11. Positioned on the dividing wall (56) is a corresponding shoulder (61). The dividing wall (56) is designed as one piece with a flange 13 which is positioned on and upstream of the carburetor (51) and through which run the air duct 4 and the mixture duct 5. The dividing walls (55, 56) and the throttle valve 7 are positioned eccentrically in the intake port 9. This produces a greater flow cross-section in the air duct 4 than in the mixture duct 5. In this arrangement, the flow cross-section relates to the narrowest cross-section. The flow cross-section is thus measured in the venturi tube (54) of the carburetor (51). The flow cross-section in the air duct 4 in the venturi tube (54) advantageously represents 55% to 90% of the total flow cross-sections in the venturi tube (54). The ratio of the flow cross-section in the air duct 4 to the flow cross-section in the mixture duct 5 is advantageously between 50:50 and 70:30.

Figure 10:
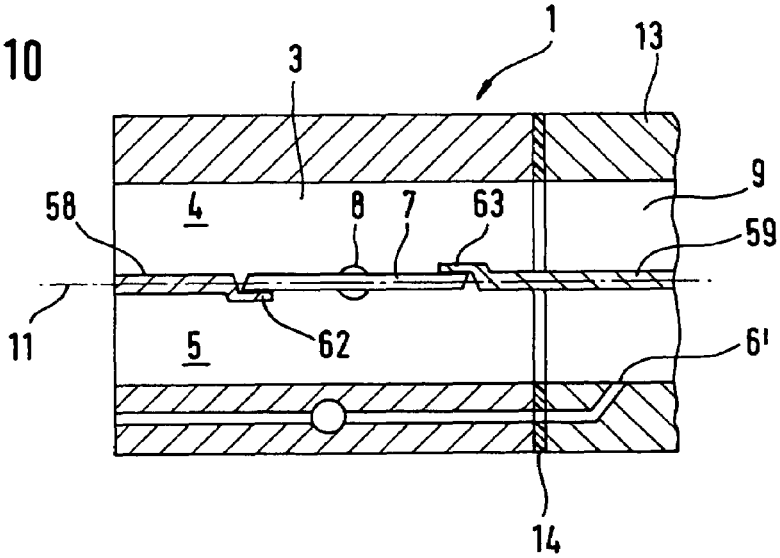

FIG. 10 shows a further embodiment of an intake device. The intake device has a carburetor 1 in which is located an intake port section 3. Mounted in the intake port section 3 in such a manner that it is able to pivot is the throttle valve 7 with the throttle shaft 8. The intake port 9 is divided centrically upstream of the throttle valve 7 by a dividing wall (58) and downstream of the throttle valve 7 by a dividing wall (59). The dividing walls (58, 59) and the throttle valve 7 are positioned centrically in the intake port 9 so that the flow cross-sections in the air duct 4 and in the mixture duct 5 are identical. When completely open, the throttle valve 7 lies against a shoulder (62) of the dividing wall (58) and a shoulder (63) of the dividing wall (59). Positioned downstream of the carburetor 1 are a seal 14 and a flange 13. The flange 13 is designed as one piece with the dividing wall (59). At the flange 13 a fuel jet 6' opens into the mixture duct 5. The fuel jet 6' is fed by a fuel metering system. The carburetor 1 has no venturi tube since fuel metering takes place exclusively via the fuel metering system. The arrangement of the fuel jet 6' in the connecting flange 13 downstream of the throttle valve 7 reliably prevents any overflowing of fuel into the air duct 4. At the same time, the manufacture of the carburetor 1 is simplified due to the simpler duct positioning.

Figure 11:
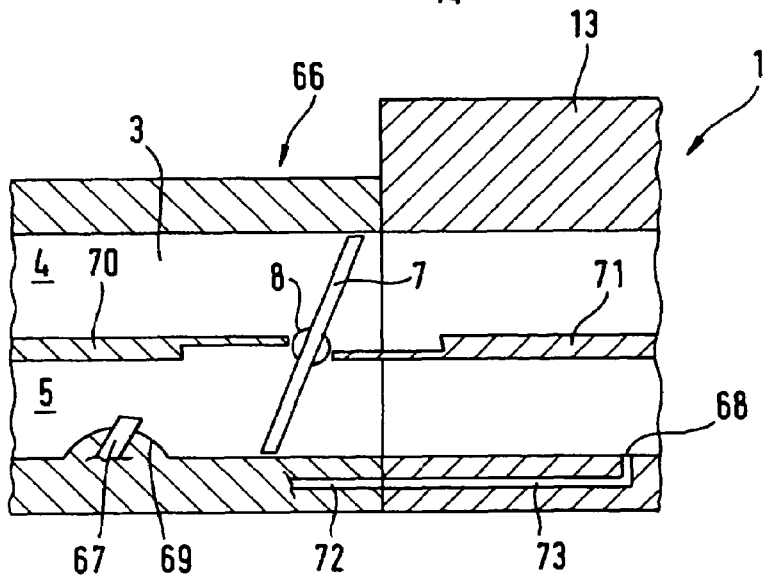

FIG. 11 shows a carburetor (66) in which is formed an intake port section 3. The throttle valve 7 is mounted in the carburetor (66) in such a manner that it is able to pivot. Upstream of the throttle valve 7 the carburetor (66) has a dividing wall (70). A dividing wall (71) is positioned downstream of the throttle valve 7. The dividing walls (70, 71) divide the intake port 9 into an air duct 4 and a mixture duct 5. Located in the mixture duct 5 in the carburetor (66) is a venturi tube (69) which is positioned upstream of the throttle valve 7. Into the venturi tube (69) opens a main jet (67) which supplies fuel to the mixture duct 5. A flange 13 is positioned downstream of the carburetor (66). The flange 13 may be a connecting flange which connects the carburetor (66) to other components downstream, for example the cylinder of an internal combustion engine. However, the flange 13 may also be the intake flange of an internal combustion engine. Into the flange 13 opens an idle jet (68) through which in the idle position of the throttle valve 7 illustrated in FIG. 11, i.e. when the throttle valve 7 has largely closed the intake port, combustion air is drawn from the mixture duct 5 upstream of the throttle valve 7. The air drawn through the main jet (67) is fed to the mixture duct 5 together with fuel carried with it from the regulating chamber of the carburetor (66) via the idle jet (68). The idle jet (68) is connected via a duct (73) in the flange 13 and a hole (72) in the carburetor (66) to the main jet(67). The hole (72) is designed as a flange hole and in this arrangement runs roughly parallel to the intake port 9. The hole (72) is connected to the duct (73) in the connection plane of the carburetor (66) and the flange 13. At idle, combustion air from the mixture duct 5 is drawn through the gap between the throttle shaft 8 and the dividing walls (70, 71) into the air duct 4. The arrangement of the idle jet (68) helps to avoid fuel from being drawn into the air duct 4 at idle.

The specification incorporates by reference the disclosure of German priority document DE 102 43 166.3 filed Sep. 18, 2002 and DE 103 26 488.4 filed Jun. 10, 2003.

The present invention is, of course, in no way restricted to the specific disclosure of the specification and drawings, but also encompasses any modifications within the scope of the appended claims.

We claim:

1. An intake device having an intake channel that includes an intake channel section, comprising:

a butterfly valve pivotably mounted in the intake channel section;

a first dividing wall disposed downstream of said butterfly valve and dividing said intake channel section into an air duct and a mixture duct, wherein said air duct has a flow cross-section that is greater than a flow cross-section of said mixture duct; and a second dividing wall, wherein said second dividing wall divides said intake channel section upstream of said butterfly valve, and wherein said second dividing wall is spaced from a longitudinal axis of a butterfly valve shaft by a distance that corresponds approximately to a radius of said butterfly valve shaft; and a fuel jet that opens into said mixture duct.

2. An intake device according to claim 1, wherein said flow cross-section of said air duct is 55 to 90% of an overall flow cross-section of said intake channel section.

3. An intake device according to claim 1, wherein a longitudinal axis of a butterfly valve shaft is spaced from a longitudinal axis of said intake channel section by a distance of 0.5 to 5 mm, and wherein said butterfly valve is in particular asymmetrically fixed in position on said butterfly valve shaft.

4. An intake device according to claim 1, wherein a central longitudinal axis of said first dividing wall is spaced from a longitudinal axis of said intake channel section by a distance that is 5 to 30% of a diameter of said intake channel section.

5. An intake device according to claim 1, wherein said first dividing wall has a thickness that is 10 to 40% of a diameter of said intake channel section.

6. An intake device according to claim 1, wherein said butterfly valve is disposed on a side of a butterfly valve shaft that faces said air duct.

7. An intake device according to claim 1, wherein said radius of said butterfly valve shaft is approximately 15 to 40% of a diameter of said intake channel section.

8. An intake device having an intake channel that includes an intake channel section, comprising:

a butterfly valve pivotably mounted in the intake channel section;

a first dividing wall disposed downstream of said butterfly valve and dividing said intake channel section into an air duct and a mixture duct, wherein said air duct has a flow cross-section that is greater than a flow cross-section of said mixture duct;

a second dividing wall, wherein said second dividing wall is disposed upstream of said butterfly valve and is a choke valve that is pivotably mounted in said intake channel section, and divides said intake channel section upstream of said butterfly valve, and wherein said second dividing wall is spaced from a longitudinal axis of a butterfly valve shaft by a distance that corresponds approximately to a radius of said butterfly valve shaft; and a fuel jet that opens into said mixture duct.

9. An intake device according to claim 8, wherein said choke valve and said butterfly valve, in open positions thereof, are inclined relative to a longitudinal axis of said intake channel section and rest against one another in an overlap area.

10. An intake device according to claim 8, wherein in said mixture duct, said butterfly valve opens in a direction of flow through said intake channel.

11. An intake device according to claim 8, which includes a fuel metering system for supplying said fuel jet, wherein said fuel metering system adjusts a quantity of fuel supplied to said mixture duct as a function of a position of said butterfly valve.

12. An intake device according to claim 8, wherein said choke valve is asymmetrically mounted on a choke shaft, and wherein said choke valve has a rectangular shape.

13. An intake device having an intake channel that includes an intake channel section, comprising:

a butterfly valve pivotably mounted in the intake channel section;

a first dividing wall disposed downstream of said butterfly valve and dividing said intake channel section into an air duct and a mixture duct, wherein said air duct has a flow cross-section that is greater that a flow cross-section of said mixture duct;

a second dividing wall, wherein said second dividing wall divides said intake channel section upstream of said butterfly valve, and wherein said second dividing wall is spaced from a longitudinal axis of a butterfly valve shaft by a distance that corresponds approximately to a radius of said butterfly valve shaft; and a fuel jet that opens into said mixture duct, wherein said fuel jet opens into said mixture duct downstream of said butterfly valve.

14. An intake device according to claim 13, wherein said fuel jet, opens into said mixture duct in a carburetor.

15. An intake device according to claim 13, wherein downstream of said butterfly valve, a portion of said intake channel section is formed in a flange, and wherein said fuel jet opens into said flange.

16. An intake device according to claim 15, wherein said fuel jet is an idling jet, and wherein a main jet is disposed upstream of said idling jet.

17. An intake device according to claim 15, wherein said first dividing wall, which is disposed downstream of said butterfly valve, is monolithically formed with said flange.

18. An intake device according to claim 15, wherein said flange is a connecting flange.

19. An intake device according to claim 15, wherein said flange is an intake flange of an internal combustion engine.

20. An intake device having an intake channel that includes an intake channel section, comprising:

a butterfly valve pivotably mounted in the intake channel section;

a first dividing wall disposed downstream of said butterfly valve and dividing said intake channel section into an air duct and a mixture duct, wherein said air duct has a flow cross-section that is greater than a flow cross-section of said mixture duct, and wherein a cross-section reducing ramp is disposed in said mixture duct, and wherein in an open position of said butterfly valve, said ramp is spaced from said butterfly valve by a distance that is 10 to 40%, of a diameter of said intake channel;

a second dividing wall, wherein said second dividing wall divides said intake channel section upstream of said butterfly valve, and wherein said second dividing wall is spaced from a longitudinal axis of a butterfly valve shaft by a distance that corresponds approximately to a radius of said butterfly valve shaft; and a fuel jet that opens into said mixture duct.

* * * * *